United States Patent [19]

Komiya

[11] Patent Number: 4,804,503

[45] Date of Patent: Feb. 14, 1989

[54] COUNTER-FLOW SQUARE TYPE COOLING TOWER

[75] Inventor: Jujiro Komiya, Fujisawa, Japan

[73] Assignee: Shinwa Sangyo Co., Ltd., Tokyo, Japan

[21] Appl. No.: 163,704

[22] Filed: Feb. 12, 1988

[30] Foreign Application Priority Data

Feb. 18, 1987 [JP] Japan ..... 62-022560[U]

[51] Int. Cl.[4] ..... B01F 3/04

[52] U.S. Cl. ..... 261/153; 261/29; 261/88; 261/83; 261/DIG. 11

[58] Field of Search ..... 261/153, 29, 88, 83, 261/DIG. 11, 25

[56] References Cited

U.S. PATENT DOCUMENTS

| | | | |
|---|---|---|---|
| 621,718 | 3/1899 | Seymour, Jr. | 261/25 |
| 960,393 | 6/1910 | Peters | 261/88 |
| 2,129,215 | 9/1938 | Howse et al. | 261/88 |
| 2,695,773 | 11/1954 | McGrath | 261/83 |
| 3,136,828 | 6/1964 | Rideout | 261/88 |
| 3,533,607 | 10/1970 | Powers | 261/25 |
| 3,596,884 | 8/1971 | Murphy | 261/25 |
| 3,784,171 | 1/1974 | Engalitcheff, Jr. et al. | 261/29 |
| 4,755,331 | 7/1988 | Merrill et al. | 261/153 |

*Primary Examiner*—Tim Miles

*Attorney, Agent, or Firm*—Oblon, Fisher, Spivak, McClelland & Maier

[57] ABSTRACT

A counter-flow square type cooling tower is provided with a sprinkler. The sprinkler has four horizontally extending sprinkler pipes. A plurality of water spraying openings are formed along the axial direction of each of the sprinkler pipes to spray cooling water downwardly, and at least one spraying opening is formed at the free end of each of the sprinkler pipes to spray the cooling water outwardly.

3 Claims, 2 Drawing Sheets

COUNTER-FLOW SQUARE TYPE COOLING TOWER

BACKGROUND OF THE INVENTION

1. Field of the Invention

The present invention relates to a counter-flow square type cooling tower with a sprinkler placed inside thereof.

2. Discussion of Background

There has so far been known a counter-flow square type cooling tower having a rectangular casing body in transverse cross-section. In the cooling tower, a filling for heat exchanging or a closed type heat exchanging unit is supported. A sprinkler type water spraying device with a plurality of sprinkler pipes is supported above the filling for heat exchanging or the closed type heat exchanging unit to spray the water on it. The water spraying device is rotatably held by a vertical hollow shaft through which the water is fed. A fan is placed above the water spraying device and in the air discharging port formed in the casing body.

In such counter-flow square type cooling tower, the water spraying device is rotated around the vertical hollow shaft to spray the water on the filling or the heat exchanging unit placed in the rectangular-shaped casing body. In this cooling tower, although the water is sufficiently sprayed onto the portion of the filling or the closed type heat exchanging unit in the central area of the rectangular-shaped casing, the cooling water does not reach the corner portions of the rectangular cooling body, whereby no water is supplied to the portion of the filling or the heat exchanging unit at the corner portions.

FIG. 3 shows a conventional counter-flow square type cooling tower A having a closed-type heat exchanger 10. A sprinkler 12 is disposed in the cooling tower casing body 11.

The closed-type heat exchanger 10 is supported below the sprinkler 12 in the casing body 11.

There is formed a water basin 13 at the bottom of the casing body 11. The water basin 13 is communicated with the sprinkler 12 by means of a vertical pipe 14 extending vertically at the outside of the casing body 11 and a suction pump 15, which constitute a cooling water circulating means, whereby the water in the water basin 13 is supplied to the sprinkler 12 by driving the pump 15. A plurality of louvers 16 are formed at the lower side surfaces of the casing body 11, and a fan 24 is supported above the sprinkler and in the air discharging port formed at the top of the casing body 11. When the fan is driven, air sucked through the louvers 16 is forced upwardly in the casing body 11, and at the same time, the cooling water sprayed from the sprinkler 12 falls downwardly, whereby the upwardly supplied air and the downwardly falling water are brought to mutual contact with each other to perform counter-flow type heat exchanging. Thus, a cooling medium flowing in the closed-type heat exchanger 10 is cooled, and at the same time, the cooling water sprayed from the sprinkler, the temperature of which is elevated by cooling the water flowing in the heat exchanger 10, is cooled by the air by latent heat effect. Thus, the water cooled by the air is collected in the water basin 13, and it is circulated again to the sprinkler 12.

In the operation of the conventional cooling tower, there is little heat exchanging effect between the air sucked through the louvers 16 and the water falling from the sprinkler at the corner portions in the casing body 11. Accordingly, at each of the corner portions, the air sucked through the louvers 16 is discharged through the discharging port by the fan without suffuring any resistance of the water; namely, it is discharged through the air discharging port in a state substantially free from a load. In the case of the cooling tower using the filling for heat exchanging, especially, the volume of the filling in the corner portions to which there is only a small supply of water, is about 20% of the entire volume. Accordingly, the heat exchanging efficiency of the cooling tower is low.

The above-mentioned problem is caused in a counter-flow square type cooling tower having a filling for heat exchanging disposed facing the louvers in addition to the above-mentioned filling for heat exchanging.

SUMMARY OF THE INVENTION

It is an object of the present invention to provide a counter-flow square type cooling tower with a sprinkler placed inside thereof which provides a sufficient heat exchanging effect between air sucked through louvers and water sprayed from the sprinkler even in a corner portion of the rectangular casing body.

The foregoing and the other objects of the present invention have been attained by providing a counter-flow square type cooling tower with a sprinkler placed inside thereof, which comprises an upright cooling tower casing having a rectangular casing body in transverse cross-section, which is provided with a fan at its open top and louvers at its lower side portions, a closed type heat exchanger or a filling for heat exchanging supported in the casing body, a cooling water circulating means including a pump which supplys water from the lower part of the casing body to the upper part, and a sprinkler rotatably held by a vertical hollow shaft in the casing body so as to be connected to the cooling water circulating means and adapted to spray the cooling water downwardly, the sprinkler comprising a plurality of horizontally extending sprinkler pipes, each having a plurality of spraying openings in the axial direction of the pipe to direct the cooling water downwardly and at least one spraying opening at the free end of the spraying pipe to direct the cooling water outwardly.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENT

Figure 1:
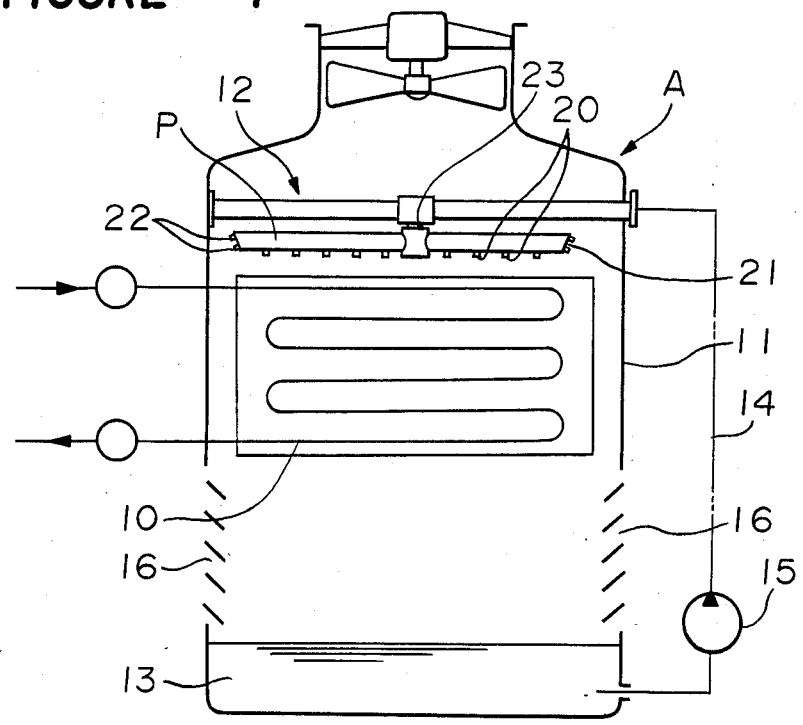
FIG. 1 is diagram showing an embodiment of the counter-flow square type cooling tower of the present invention.

In the following, a preferred embodiment of the present invention will be described with reference to FIGS. 1 and 2, wherein the same reference numerals designate the same or corresponding parts, and therefore, description of these parts is omitted.

Figure 2:
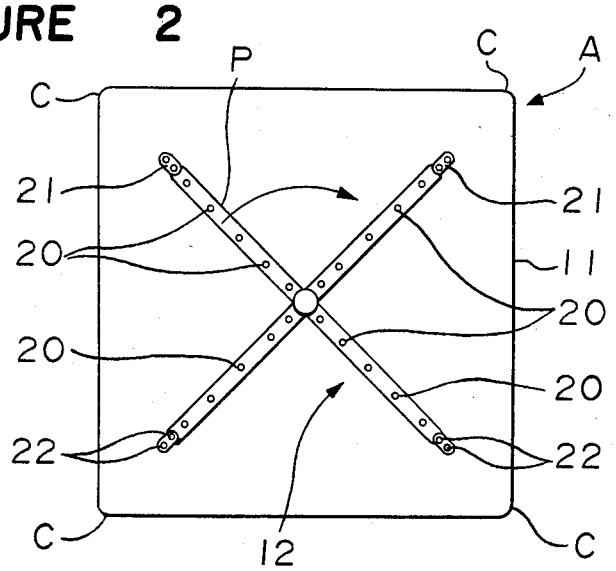
FIG. 2 is a diagram showing a sprinkler used for the cooling tower of the present invention.
Figure 3:
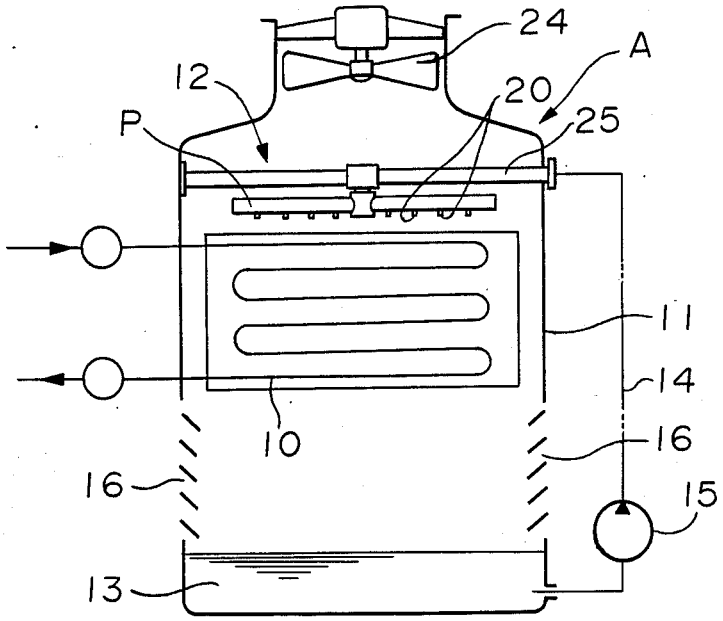
FIG. 3 is a diagram showing a conventional counter-flow square type cooling tower.

In FIGS. 1 and 2, a sprinkler 12 used for a counter-flow square type cooling tower A is rotatably supported by a vertical hollow shaft 23 through which water in the water basin 13 is supplied to the sprinkler via the vertically extending pipe 14, a laterally extending pipe 25 and the suction pump 15. The laterally extending pipe 25 functions as a supporting means for the sprinkler 12. The sprinkler 12 comprises four sprinkler pipes P which extend horizontally in the radial direction at equal angular positions, and are communicatively connected to the vertical hollow shaft 23 which is rotated by a driving means (not shown).

Each of the sprinkler pipes P is provided with a plurality of spraying openings or nozzles 20 in the longitudinal direction, i.e. along the axial line of the pipe, with equal intervals over the entire length of the pipe P. The free end of each of the sprinkler pipes P is cut so as to be downwardly inclined, and an end plate 21 with at least one water spraying opening or nozzle 22 is attached to the open free end so that the water is sprayed outwardly to reach the inner corner portions C of the casing body 11. Thus, a sufficient amount of water can be supplied to the four corner portions in the rectangular casing body during the rotation of the sprinkler 12. Further, the heat exchanging between the air sucked through the louvers 16 and the sprayed water can be satisfactorily carried out to thereby increase heat exchanging efficiency. Thus, the filling for heat exchanging or the closed type heat exchanger unit can be effectively utilized.

In the counter-flow square type cooling tower present invention, the free end of the sprinkler pipes P is cut so as to be inwardly inclined and the end plate 21 with one or more nozzles 22 is attached to the free end. Accordingly, the area for forming the nozzles 22 can be broaden so that the number of the nozzles can be increased. Further, with the provision of the nozzles 22, a sufficient amount of the water can be supplied to the corner portions C and the inner wall of the casing body 11, whereby a sufficient amount of water is supplied to each of the corners. In addition, since the inner circumferential wall of the casing body 11 becomes wet, there is obtainable effective heat exchanging function between the water and the air, and between a cooling medium flowing in the heat exchanger 10 and the water.

In the above-mentioned embodiment, the same effect can be obtained by a cooling tower A with a filling for heat exchanging as well as the cooling tower having the closed-type heat exchanger 10.

Obviously, numerous modifications and variations of the present invention are possible in light of the above teachings. It is therefore to be understood that within the scope of the appended claims, the invention may be practiced otherwise than as specifically described herein.

What is claimed is:

1. A counter-flow square type cooling tower with a sprinkler placed inside thereof, which comprises:

an upright cooling tower casing having a rectangular casing body in transverse cross-section, which is provided with a fan at its open top and louvers at its lower side portions, a closed type heat exchanger or a filling for heat exchanging supported in said casing body, a cooling water circulating means including a pump which supplys water from the lower part of said casing body to the upper part; and a sprinkler rotatably held by a vertical hollow shaft in said casing body so as to be connected to said cooling water circulating means and adapted to spray the cooling water downwardly, said sprinkler comprising a plurality of horizontally extending sprinkler pipes, each having a plurality of spraying openings in the axial direction of the pipe to direct the cooling water downwardly and at least one spraying opening at the free end of said spraying pipe to direct the cooling water outwardly.

2. The counter-flow square type cooling tower according to claim 1, wherein said free end of said sprinkler pipe is cut so as to be downwardly inclined and an end plate with said at least one water spraying opening is attached thereto.

3. The counter-flow square type cooling tower according to claim 1, wherein four of said sprinkler pipes are communicatively connected to said vertical hollow shaft which is communicatively connected to said cooling water circulating means.

* * * * *